US005110547A

United States Patent [19]

Kiuchi et al.

[11] Patent Number: 5,110,547

[45] Date of Patent: May 5, 1992

[54] PROCESS AND APPARATUS FOR THE PRODUCTION OF SEMI-SOLIDIFIED METAL COMPOSITION

[75] Inventors: Manabu Kiuchi, Zushi; Masazumi Hirai, Chiba; Yasuo Fujikawa, Chiba; Ryuji Yamaguchi, Chiba; Akihiko Nanba, Chiba; Masato Noda, Chiba, all of Japan

[73] Assignee: Rheo-Technology, Ltd., Japan

[21] Appl. No.: 692,444

[22] Filed: Apr. 25, 1991

[30] Foreign Application Priority Data

| | | | |
|---|---|---|---|
| Oct. 29, 1990 | [JP] | Japan | 2-288383 |
| Dec. 28, 1990 | [JP] | Japan | 2-418096 |
| Feb. 28, 1991 | [JP] | Japan | 3-055584 |
| Feb. 28, 1991 | [JP] | Japan | 3-055585 |

[51] Int. Cl.[5] ..... B22D 11/00

[52] U.S. Cl. ..... 420/590; 164/418; 164/442; 266/204

[58] Field of Search ..... 420/590; 164/418, 442; 266/204

[56] References Cited

U.S. PATENT DOCUMENTS

| | | | |
|---|---|---|---|
| 3,840,364 | 10/1974 | Flemings | 420/590 |
| 3,902,544 | 9/1975 | Flemings | 420/590 |
| 3,948,650 | 4/1976 | Flemings | 420/590 |
| 3,951,651 | 4/1976 | Mehrabian | 420/590 |
| 4,830,086 | 5/1989 | Kobayashi | 164/418 |

*Primary Examiner*—Peter D. Rosenberg
*Attorney, Agent, or Firm*—Austin R. Miller

[57] ABSTRACT

In a process and an apparatus for stably and continuously producing a solid-liquid metal mixture in which non-dendritic primary solid particles are dispersed into the remaining liquid matrix, molten metal is charged into a clearance between a wall member and a rotating agitator composed of a cylindrical drum having a horizontally rotational axis.

14 Claims, 10 Drawing Sheets

PROCESS AND APPARATUS FOR THE PRODUCTION OF SEMI-SOLIDIFIED METAL COMPOSITION

BACKGROUND OF THE INVENTION

1. Field of the Invention

This invention relates to a process for stably and continuously producing a solid-liquid metal mixture in which non-dendritic primary solid particles are dispersed into the remaining liquid matrix (hereinafter referred to as a semi-solidified metal composition) and an apparatus used therefor.

The term "semi-solidified metal composition" used herein means that molten metal (generally molten alloy) is vigorously agitated while cooling to (1) convert dendrites produced in the remaining liquid matrix into a spheroidal or granular shape such that dendritic branches are substantially eliminated or reduced creating non-dendritic primary solid particles) and (2) disperse these primary solid particles into the liquid matrix.

2. Related Art Statement

The semi-solidified metal composition develops excellent working properties at subsequent steps such as casting or the like as well as excellent quality of cast articles as the non-dendritic primary solid particles dispersed in the liquid matrix become increasingly fine. In the production of the semi-solidified metal composition, therefore, it is required to satisfy the following two conditions:

(1) vigorous agitation capable of breaking and separating dendrites to fine non-dendritic primary solid particles in which dendritic branches eliminated or reduced to create particles of a generally spheroidal or granular shape;

(2) strong cooling capable of maximizing the cooling rate.

However, the viscosity increase together with the increase of fraction solid in the production of the semi-solidified metal composition renders it difficult to continuously discharge the semi-solidified metal composition from the production apparatus and, finally, the discharge becomes impossible.

As a process for continuously producing such a semi-solidified metal composition, Japanese Patent Application Publication No. 56-20944 discloses a process wherein molten metal is vigorously agitated in a cylindrical cooling agitation vessel through high rotation of an agitator while cooling to convert dendrites produced in the remaining liquid matrix into non-dendritic primary solid particles in which dendritic branches are eliminated or reduced to create particles of a spheroidal or granular shape, and then these non-dendritic primary solid particles are dispersed into the liquid matrix to form a slurry of semi-solidified metal composition, which is continuously discharged from a nozzle arranged at the bottom of the cooling agitation vessel.

In this process, molten metal is charged into a clearance between the high-speed rotating agitator having a vertically rotational axis and the coaxially arranged cylindrical cooling agitation vessel, molten metal is changed into a semi-solidified state through proper cooling and vigorous agitation in the vessel, and then the molten melt is continuously discharged from the nozzle as a semi-solidified metal composition. According to this process, the cooling rate is undesirably restricted to not more than 2° C./s (in the case of Al-10% Cu alloy) to prevent clogging in the clearance due to the formation and growth of solidification shell on the cooled wall face. And also, it is difficult to control the agitating degree, cooling rate and discharging rate due to the growth of the solidification shell.

The inventors have examined the above technique and confirmed the following problems:

(i) In order to enhance the agitating effect, it is effective to increase the revolution number of the rotating agitator or make the clearance between the cooling agitation vessel and the agitator arranged therein small. However, when the revolution number is increased, the liquid matrix strongly tends to separate away from the agitator through centrifugal force and increases the risk of entrapping gas. And also, the increase of the revolution number is critical in view of the structural strength.

On the other hand, when the clearance is made small, the solidification shell is easily formed and the viscosity resistance increases, so that the clearance can not be made small in practical use.

(ii) When a strong cooling means is adopted for increasing the cooling rate, the solidification shell formed on the cooled wall face causes adhesion to the agitator, whereby the operation is rendered impossible.

(iii) In non-steady heat transfer such as initial operation stage or the like, it is difficult to control temperature, and hence the adhesion of solidification shell to the agitator may be caused due to excessive cooling. That is, it is difficult to stably start the operation.

(iv) When the semi-solidified metal composition is discharged under gravity, the force for passing the semi-solidified metal composition through the clearance between the cooling agitation vessel and the agitator is only a pressure based on the gravity, so that the discharging is rendered impossible when the fraction solid in the semi-solidified metal composition increases to raise the viscosity.

SUMMARY OF THE INVENTION

It is, therefore, an object of the invention to effectively solve the aforementioned problems of the conventional technique.

The inventors have made various studies considering the following important conditions:

(1) the agitating effect is enhanced;

(2) the cooling rate is increased;

(3) the homogeneous semi-solidified metal composition is continuously and easily discharged without entrapping gas and the like.

In general, the agitating effect is in proportion to the revolution number of the rotating agitator. That is, as the diameter of the agitator becomes large or as the clearance between the agitator and the cooled wall face becomes small, the sufficient agitating effect is obtained without requiring the high-speed rotation. In addition, it has been noticed that according to the conventional technique, the clearance between the agitator and the cooled wall face can not be controlled during the operation and the discharging force of the semi-solidified metal composition is only the gravity. Moreover, the rotational axis of the agitator is vertical in the conventional technique.

Under the above circumstances, the invention has been accomplished and lies in the point that the rotational axis of the agitator is horizontal.

According to a first aspect of the invention, there is the provision of a process for producing semi-solidified metal compositions, which comprises (1) continuously charging molten metal into a clearance defined between a rotating agitator composed of a cylindrical drum having a horizontally rotational axis and a wall member having a concave face along an outer periphery of the drum, (2) breaking dendrites, which are produced in the remaining liquid matrix in the clearance by solidification based on forced cooling, through shearing force based on the rotation of the agitator to form a semi-solidified metal composition suspending fine non-dendritic primary solid particles, and (3) continuously discharging out the semi-solidified metal composition from a lower part of the clearance.

According to a second aspect of the invention, there is the provision of an apparatus for producing semi-solidified metal compositions, comprising a rotating agitator composed of a cylindrical drum and a wall member having a concave face along an outer periphery of the drum, characterized in that the agitator has a horizontally rotational axis.

In preferred embodiments of the first invention, the forced cooling is carried out by passing a cooling water through the inside of the agitator and/or the wall member, and the clearance is properly adjusted by detecting load torque of the agitator to move the agitator or the wall member, and solidification shell adhered to the outer peripheral surface of the drum is scraped off by means of a scraping member arranged near to the drum at a discharge port for continuously discharging the semi-solidified metal composition from the lower part of the clearance, and a water-cooled rotating roll is arranged at the lower end of the wall member located opposite to the scraping member below the clearance so that the rotational axis is parallel to the rotational axis of the agitator, and the peripheral speed of the agitator is higher than that of the water-cooled rotating roll, and a slide valve is arranged beneath the clearance to hold the semi-solidified metal composition and adjust the discharging rate of the semi-solidified metal composition and the shape of the discharge port above slide valve, and the the semi-solidified metal composition is horizontally discharged in a tangential direction of the outer periphery of the drum and placed onto a belt or caterpillar for continuous introduction into subsequent steps, and the discharge of the semi-solidified metal composition is adjusted by controlling the take-up velocity of the belt or caterpillar.

In preferred embodiments of the second invention, a torque detector is arranged on the rotational axis of the agitator, and a cooling means is arranged inside the wall member and/or the agitator, and a scraping means for scraping solidification shell adhered to the outer peripheral face of the drum is arranged near to the outer periphery of the drum beneath the clearance, and a water-cooled rotating roll is arranged at the lower end of the wall member located opposite to the scraping member below the clearance so that the rotational axis is parallel to the rotational axis of the agitator, and a slide valve is arranged beneath the slide valve.

BRIEF DESCRIPTION OF THE DRAWINGS

The invention will be described with reference to the accompanying drawings, wherein.

FIG. *2a* is a schematic view illustrating a first embodiment of the apparatus according to the invention;

FIG. *2b* is a front view of the apparatus shown in FIG. *2a;*

Figure 3:
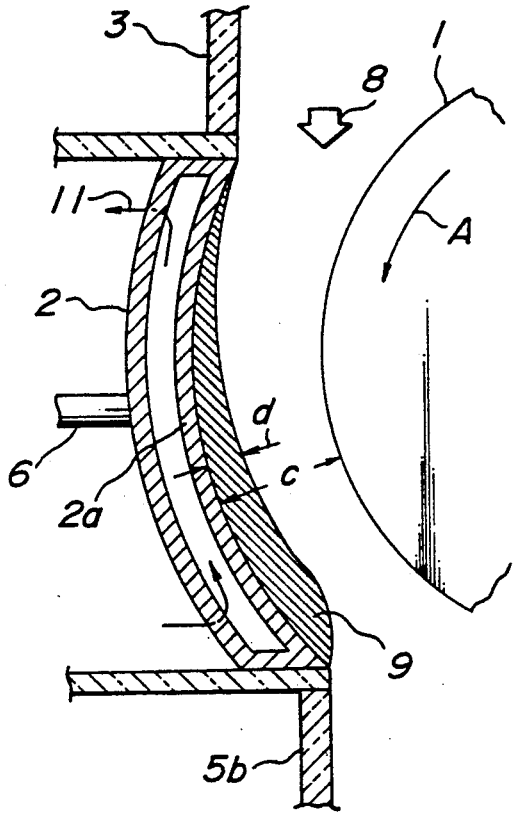

FIG. 3 is an enlargedly schematic view of a cooling agitation portion of the apparatus shown in FIG. *2a;*

Figure 4:
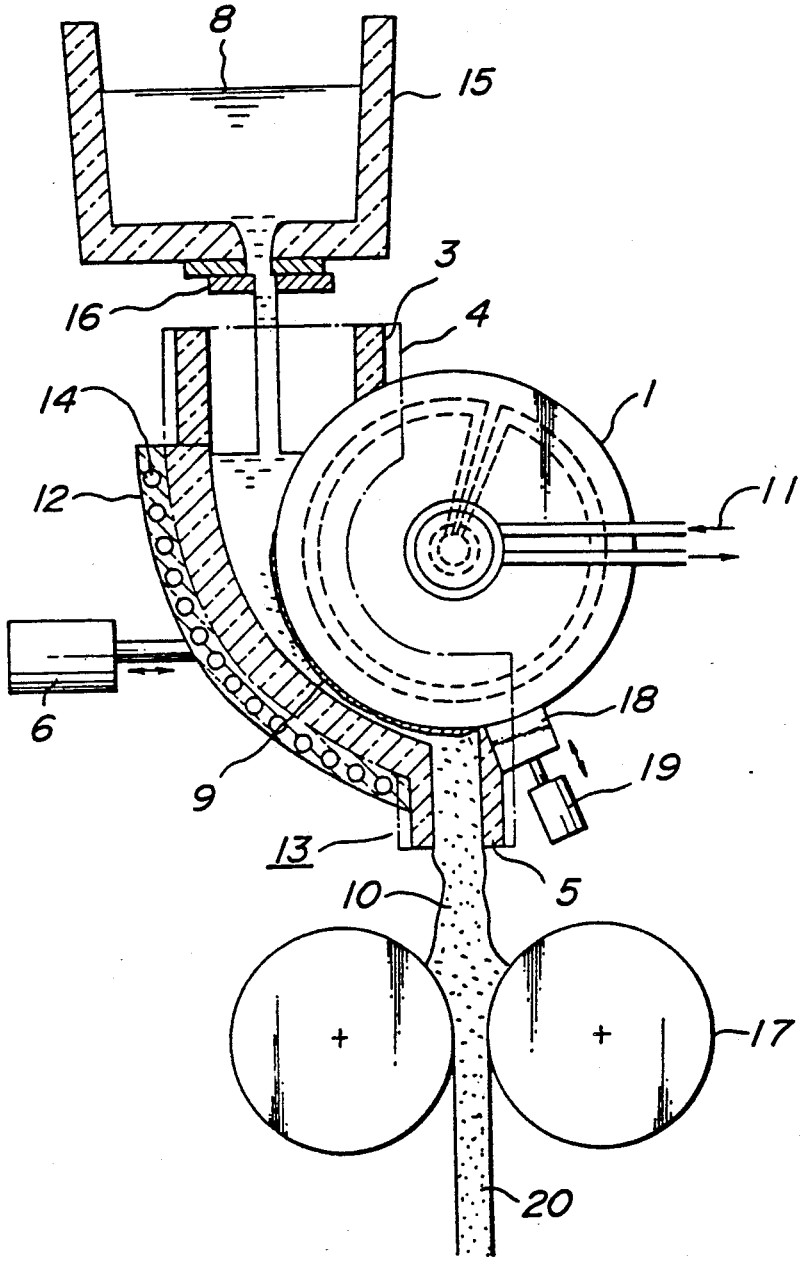
Figure 5:
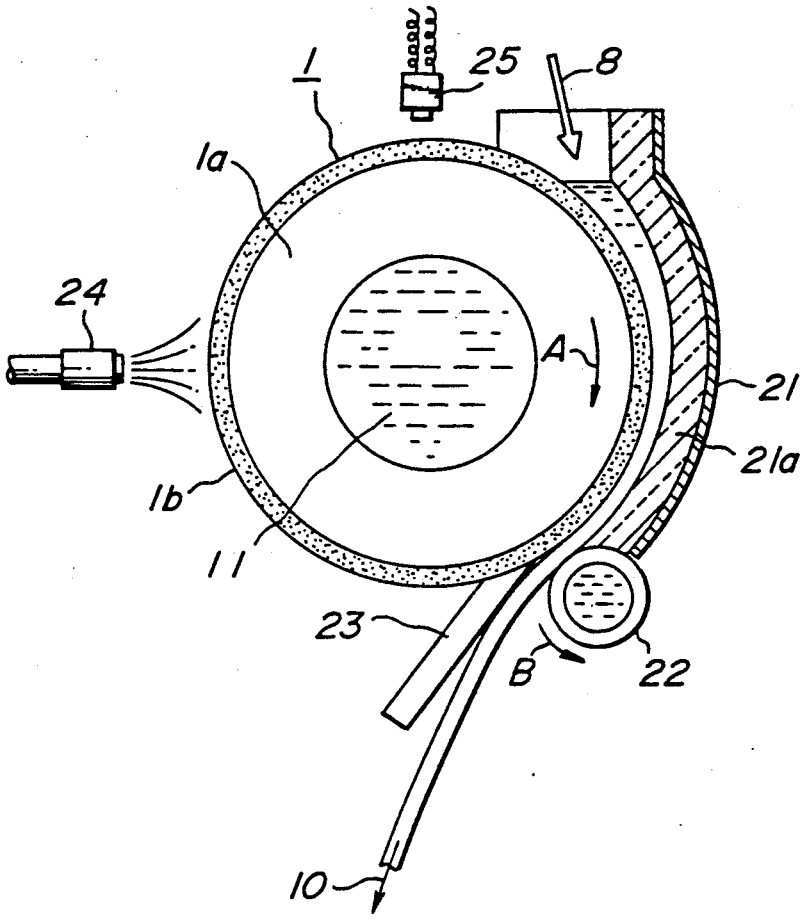
Figure 6:
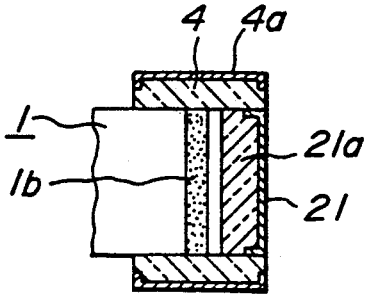
Figure 7:
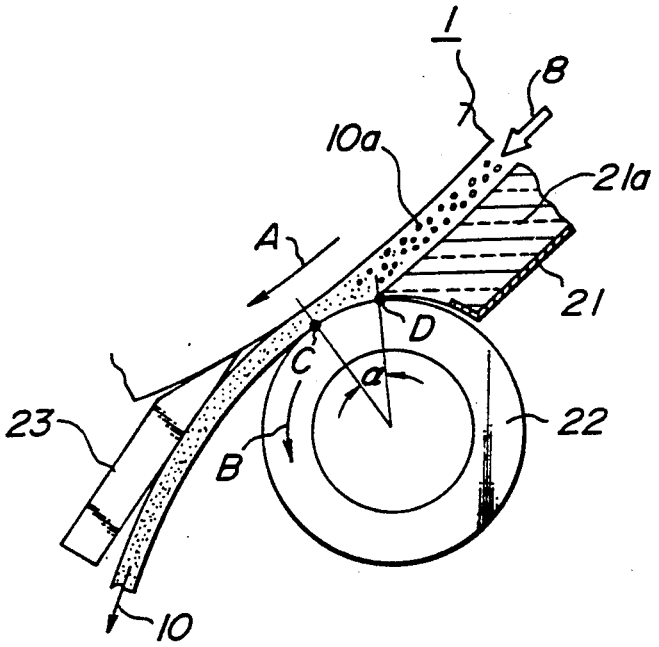
Figure 8:
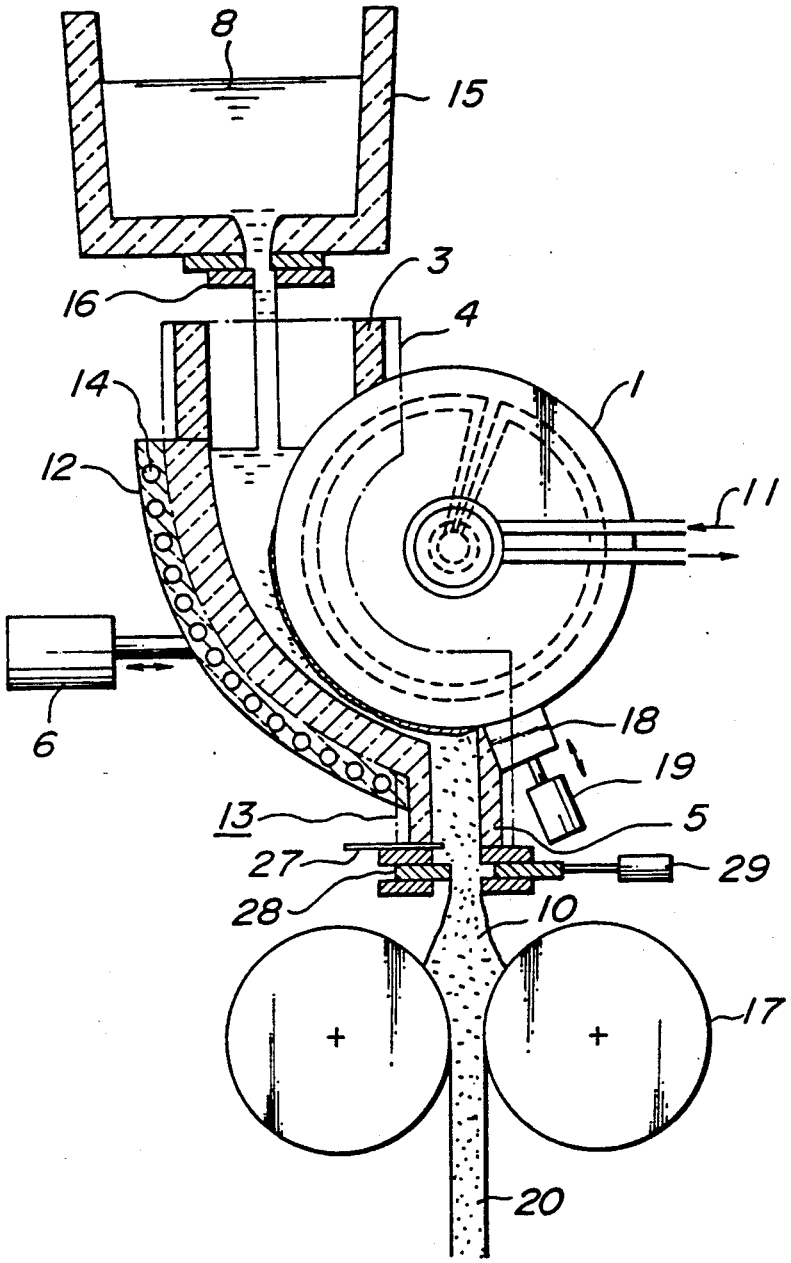
Figure 9:
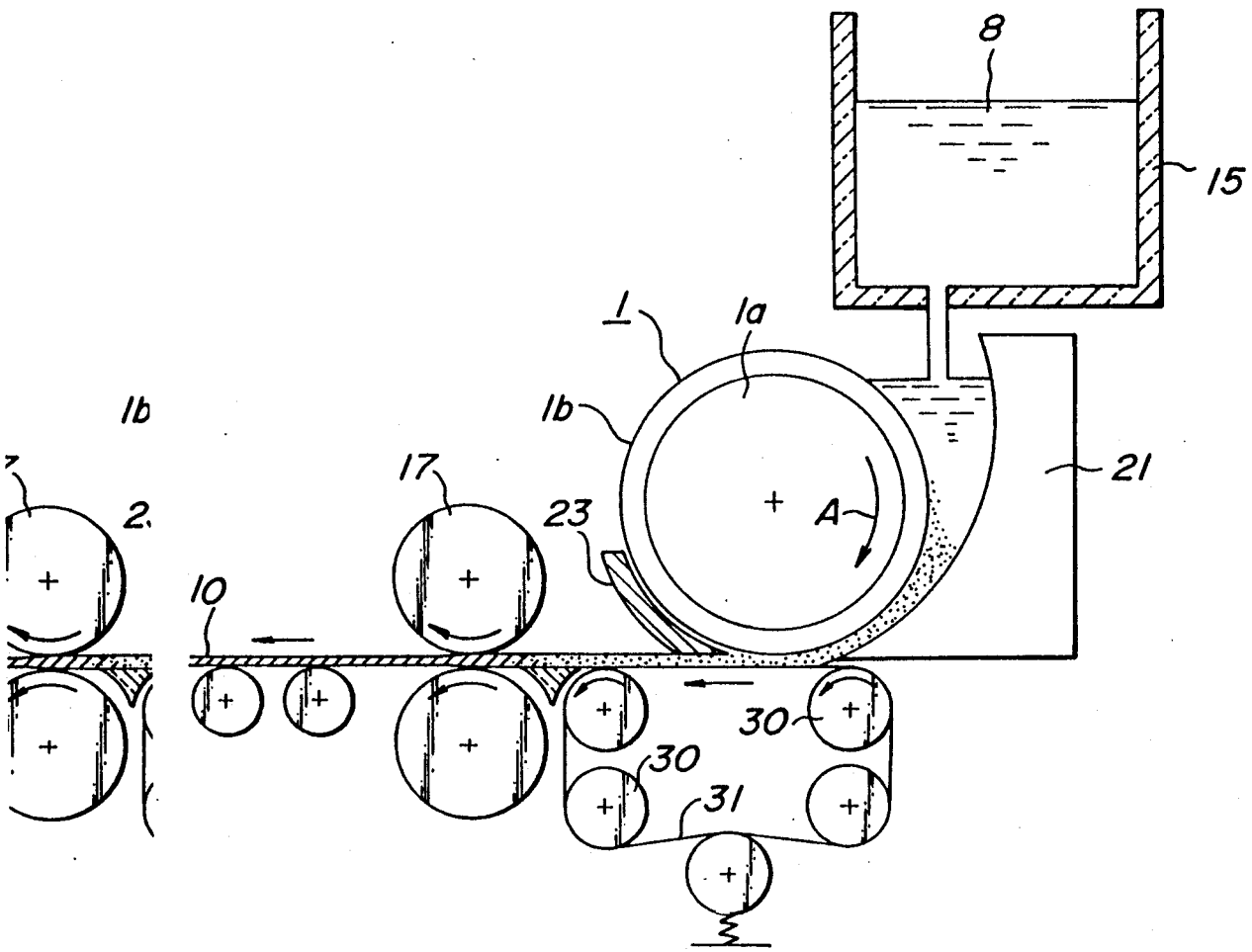
Figure 10:
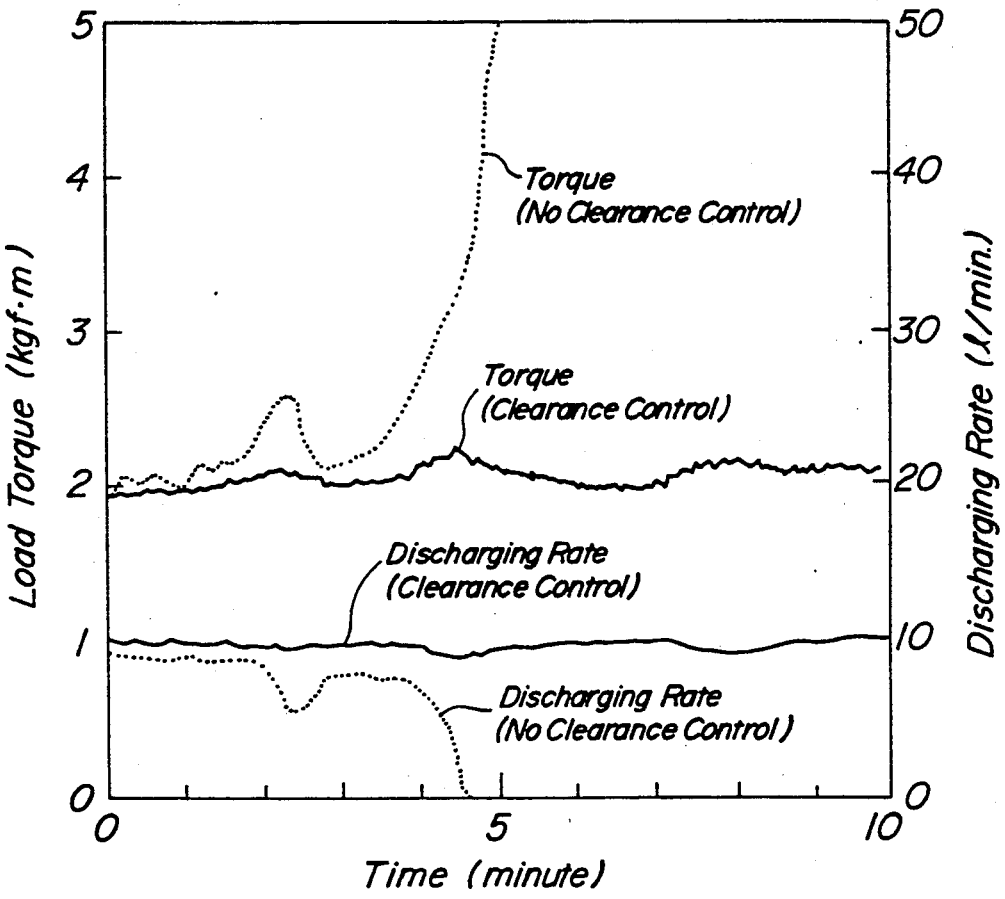
Figure 11:
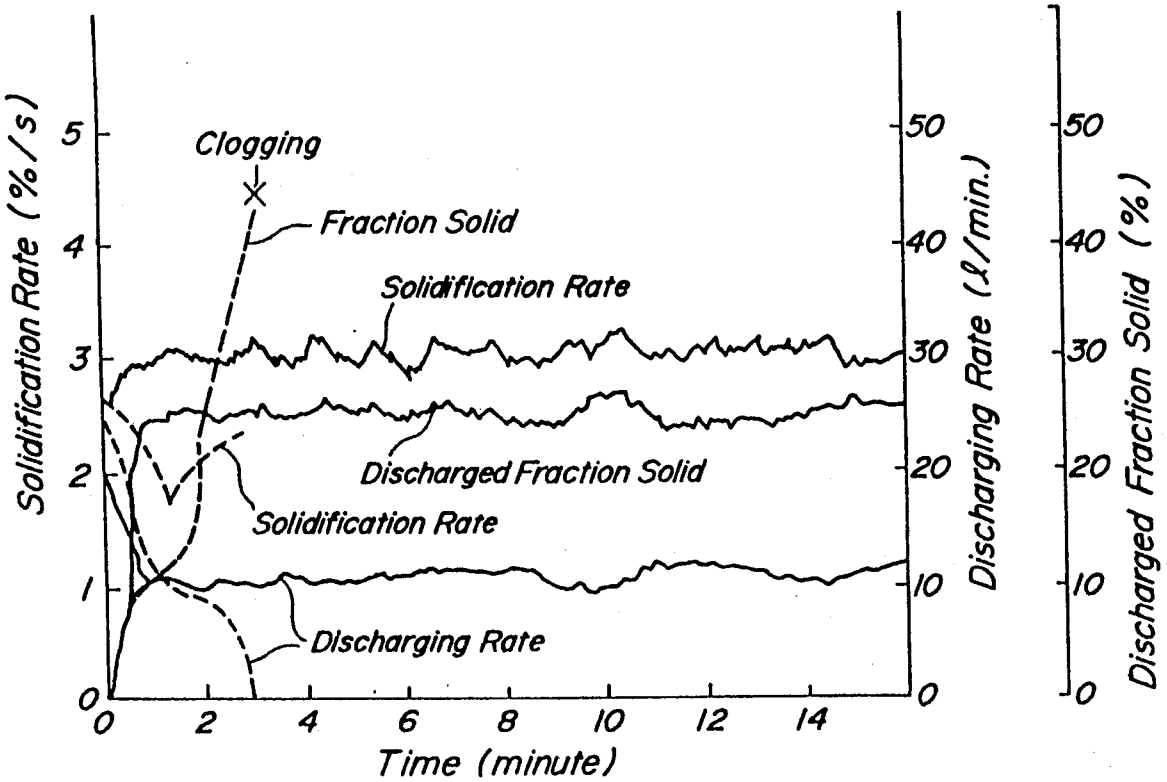

FIG. 4 is a schematic view of a second embodiment of the apparatus according to the invention;

FIG. 5 is a longitudinally sectional view of a third embodiment of the apparatus according to the invention;

FIG. 6 is a laterally sectional side view of a seal portion in the apparatus shown in FIG. 5;

FIG. 7 is an enlargedly sectional view of a discharge portion in the apparatus shown in FIG. 5;

FIG. 8 is a schematic view of a fourth embodiment of the apparatus according to the invention;

FIG. 9 is a schematic view of a fifth embodiment of the apparatus according to the invention;

FIG. 10 is a graph showing a relation between load torque and time when the clearance is controlled so as to make the load torque of the agitator in the operation of the first embodiment; and FIG. 11 is a graph showing a relation among solidification rate, shear rate, discharging rate and fraction solid with respect to the discharging time in the apparatus of the second embodiment.

DESCRIPTION OF THE PREFERRED EMBODIMENTS

According to the invention, the rotational axis of the rotating agitator composed of the cylindrical drum is horizontal, so that it is easy to make the diameter of the agitator large, whereby the vigorous agitating action can be given without considerably increasing the revolution number of the agitator. And also, when the rotating agitator is provided with a water cooling means, an area for cooling molten metal can be increased, so that rapid cooling can be attained. Therefore, the sufficient cooling and agitating effects can be obtained while adjusting and maintaining optimum clearance for the discharge of the semi-solidified metal composition.

Furthermore, the discharging force of the semi-solidified metal composition is a sum of gravity and a force based on the rotation of the agitator for promoting the flowing of the semi-solidified metal composition, so that the semi-solidified metal composition having higher fraction solid and viscosity can be discharged. As a result, the start of the operation is easy and troubles such as clogging of the clearance with the semi-solidified metal composition and the like can be avoided and hence the stable and steady operation can be attained.

If it is intended to supply the semi-solidified metal composition to a twin roll casting machine or the like at subsequent steps, according to the conventional technique, it is very difficult to uniformly supply the semi-solidified metal composition between the rolls, while according to the invention, the semi-solidified metal composition to be discharged is uniform in the longitudinal direction of the agitator, so that the casting can easily be made in the twin roll casting machine.

In general, it is well-known that the quality of the semi-solidified metal composition such as crystal particle size and the like is largely influenced by a cooling rate in the production of the semi-solidified metal composition or an increasing rate of fraction solid per unit time at solid-liquid coexisting state (hereinafter referred to as a solidification rate), an average value of rate change per unit distance of fluid depended on the agitating rate (hereinafter referred to as a shear strain rate), a fraction solid and the like.

In order to continuously and stably discharge the semi-solidified metal composition having a poor fluidity from the production apparatus, it is required to stably ensure a given sectional area of the discharge port. Even in the apparatus for the production of the semi-solidified metal composition comprising the cylindrical drum having a horizontally rotational axis and the fixed wall member, in order to continuously and stably produce and discharge the semi-solidified metal composition having desired quality over a long time, it is also required to prevent the formation and growth of solidification shell in the cooling agitation zone and stabilize cooling rate, solidification rate, shear rate, fraction solid and discharging rate.

The inventors have made further studies with respect to various factors which affect crystal particle size, fraction solid and discharging rate of desirable semi-solidified metal composition to be stably and continuously discharged from the production apparatus.

Figure 1:
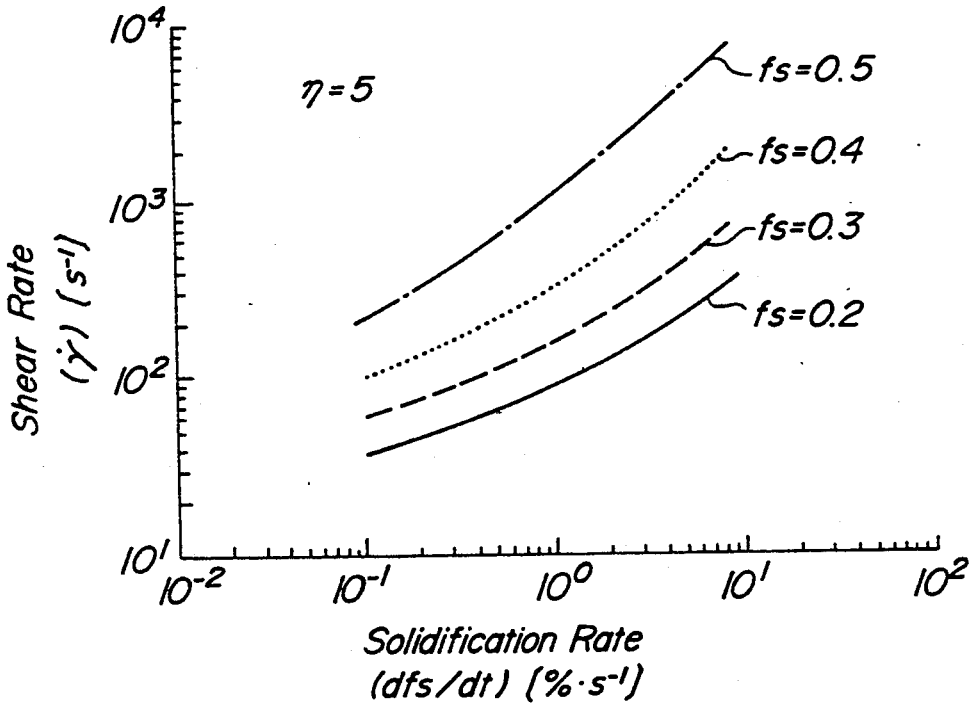
FIG. 1 is a graph showing a relation between fraction solid of semi-solidified metal composition and apparent viscosity.

In general, apparent viscosity, as an indication of fluidity ($\eta$) in the semi-solidified metal composition, is largely influenced by a suspension degree or fraction solid (fs) in the liquid matrix as well as the solidification rate and shear rate in the production of the semi-solidified metal composition as shown in FIG. 1. That is, as the fraction solid becomes high, the viscosity becomes higher, but there is a limit fraction solid as an upper limit capable of fluidizing the semi-solidifed metal composition. Such a limit fraction solid is known to become small as the solidification rate in the production of the semi-solidified metal composition is larger or the shear rate is smaller. Therefore, the fraction solid or viscosity capable of discharging the semi-solidified metal composition is naturally determined by the solidification rate, shear rate, discharging rate and shape of the discharge port in the apparatus for the production of the semi-solidified metal composition, so that semi-solidified metal composition having a value larger than the dischargeable fraction solid or viscosity can not be discharged. In order to raise the dischargeable fraction solid or viscosity for stably and continuously discharging the semi-solidified metal composition at given solidification rate and fraction solid over a long time, the inventors have made many experiments for the production of a slurry of semi-solidified metal composition under various solidification rates, agitating conditions and discharging conditions, and examined with respect to a relation among cooling conditions and fraction solid in the cooling agitation of the semi-solidified metal composition and a relation of formation state of solidification shell on cooled wall face to the solidification rate and discharging rate, and as a result it has been found that the above problems can advantageously be solved by selecting the cooling manner at cooling agitation portion enabling stable discharging operation and further using a scraping member for removing solidification shell formed on the cooled wall face.

That is, according to the invention, the forced cooling is carried out by passing a cooling water through the inside of the wall member and/or the agitator and scraping solidification shell formed on the outer surface of the drum as an agitator with a scraping member arranged in the discharge port for continuously discharging the semi-solidified metal composition from the lower part of the clearance.

In order to better ensure the stable discharging, a mechanism capable of varying the sectional shape and sectional area of the discharge port, i.e. a slide valve is arranged beneath the clearance, whereby the holding of the semi-solidified metal composition and the adjustment of the discharging rate and shape of the discharge port can be attained above the slide valve.

Furthermore, a water-cooled rotating roll is located at the lower part of the wall member beneath the clearance between the cylindrical drum as a rotating agitator and the wall member, and driven together with the agitator, whereby the semi-solidified metal composition formed and collected in the lower part of the clearance can continuously be contacted with the water-cooled rotating roll to further cool and solidify into a sheet product.

In this case, the water-cooled rotating roll strongly cools and solidifies the semi-solidified metal composition, so that it is preferably made from a metal having a high heat conductivity capable of conducting strong cooling.

Moreover, when the semi-solidified metal composition is continuously discharged from the lower part of the clearance, the discharging property may largely be dependent upon the structure of the discharge portion. Particularly, the following problems are considered to be caused:

(1) When the slurry flow of the semi-solidified metal composition is changed at the discharge portion from the rotating direction of the agitator toward a direction perpendicular thereto, if the fraction solid is high, the flow piles up in the discharge portion to finally cause the clogging of the discharge port.

(2) Even if the semi-solidified metal composition is discharged, the discharged slurry falls down from the discharge port at an aggregated or scattered state to cause the entrapment of air or gas, which causes serious problems in view of the transfer to subsequent steps and the quality of final product.

In order to solve these problems, it is favorable that the semi-solidified metal composition is taken out from the discharge port in a direction tangential to the rotating direction of the agitator and placed onto a belt or caterpillar to continuously feed to subsequent steps. Such a tangential direction is desirable to be horizontal for reducing the construction cost and lowering the equipment height. Furthermore, the discharging rate is controlled by adjusting the moving rate of the belt or caterpillar.

Figure 2A:
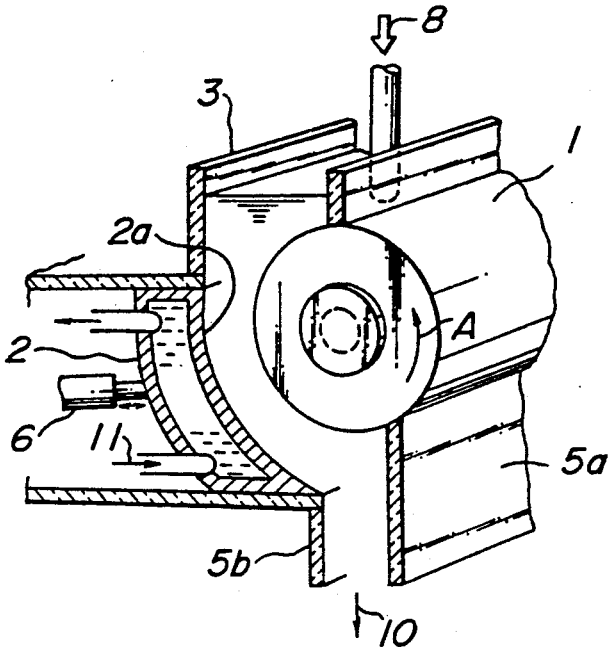
Figure 2B:
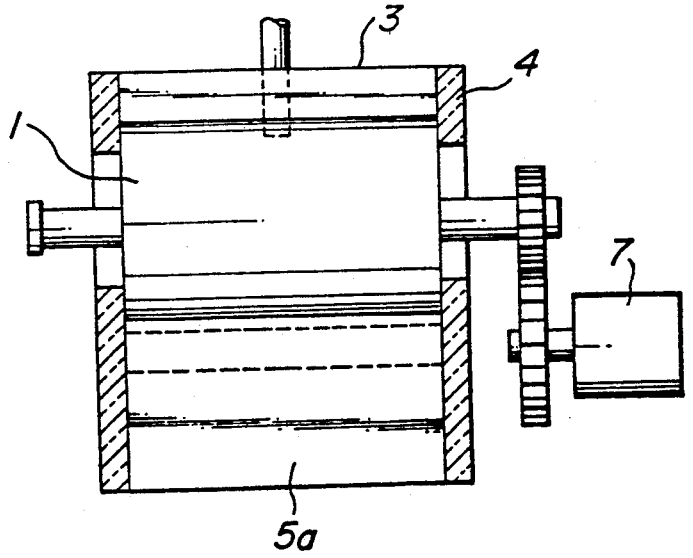

A first embodiment of the invention will be described with reference to an apparatus for the production of semi-solidified metal composition shown in FIGS. 2*a* and 2*b*.

The illustrated apparatus comprises a rotating agitator composed of a cylindrical drum having a horizontally rotational axis, a water cooling jacket 2 having a cooling wall 2*a*, a refractory plate 3 and a refractory side plate 4 constituting a molten metal reservoir, refractory plates 5*a* and 5*b* constituting a discharge portion, a driving mechanism 6 for adjusting a clearance between the cooling wall 2*a* and the rotating agitator 1, and a driving mechanism 7 for rotating the agitator 1.

The agitator 1 is rotated by means of the driving mechanism 7, whereby the agitating action is applied to molten metal under cooling to break dendrites produced in the remaining liquid matrix into fine non-dendritic primary solid particles, which are uniformly dispersed into the resulting semi-solidified metal composition. The diameter of the agitator 1 is determined by the amount of the semi-solidified metal composition to be discharged and the cooling ability. The agitator 1 usually controls the cooling rate by coating the outer surface of the agitator with a refractory, but if it is intended to increase the cooling rate of the semi-solidified metal composition, the agitator 1 may be cooled by passing a cooling water through the inside of the agitator made from a metal.

In the water cooling jacket 2 having a cooling wall 2*a*, the forced cooling is carried out by passing a cooling water 11 through the inside of the jacket 2, whereby molten metal is directly cooled down to a semi-solidification temperature. Furthermore, the jacket 2 is connected to a hydraulic driving mechanism 6, whereby the cooling wall 2*a* can be moved toward a radial direction of the agitator 1 to adjust a clearance between the rotating agitator 1 and the cooling wall 2*a* of the jacket 2.

The refractory plate 3 located above the water cooling jacket 2 constitutes a molten metal reservoir for covering a change of amount of molten metal 8 to be poured. The side refractory plate 4 used for preventing leakage of molten metal is closed to the side face of the jacket 2 and slidably adhered to the side face of the rotating agitator 1 at a very slight space.

The discharge portion of the clearance is constituted with a front refractory plate 5*a* and a rear refractory plate 5*b* along the longitudinal direction of the agitator 1, whereby the resulting semi-solidified metal composition 10 is uniformly discharged from the discharge portion in the longitudinal direction of the agitator 1.

At first, molten metal transferred by a ladle is supplied to the clearance between the rotating agitator and the cooling wall through a pouring nozzle. The supplied molten metal is cooled by the water cooling wall to drop down the temperature, while strong shearing force is applied thereto by the rotating agitator. In this case, the agitator is rotated so as to promote the flowing of the resulting semi-solidified metal composition (as shown by an arrow A in FIG. 2*a*), which is added to gravity as a discharging force for the semi-solidified metal composition. Thus, the semi-solidified metal composition having a high viscosity can easily and uniformly be discharged from the discharge portion.

Since the agitator is rotated at a certain rotating rate, torque loaded to the agitator is detected by means of a torque detector. Based on the detected value, the hydraulic driving mechanism is actuated to move the water cooling jacket toward the radial direction of the rotating agitator, whereby the clearance between the cooling wall and the agitator is adjusted to an optimum clearance passing the semi-solidified metal composition. Thus, the semi-solidified metal composition having a constant viscosity can be discharged, so that the clogging inside the apparatus with the semi-solidified metal composition due to rapid change of the cooling conditions can be avoided.

The behavior created in a cooling agitation zone defined by the cooling wall and the rotating agitator will be described in detail with reference to FIG. 3.

According to the invention, the cooling wall 2*a* of the water cooling jacket 2 is made from copper plate for increasing the cooling rate as far as possible, and a cooling water is passed through the inside of the jacket 2 at a high speed, whereby rapid cooling can be attained. Molten metal 8 charged in a clearance between the cooling wall 2*a* and the rotating agitator 1 is forcedly cooled by direct contact with the cooling wall 2*a* to form solidification shell 9 on the cooling wall. The thickness d of the solidification shell 9 is determined by the balance between cooling ability and the agitating effect and becomes very unstable in the operation. Particularly, the thickness of the solidification shell tends to become thicker in the starting of the operation.

On the other hand, the agitating effect given by the rotation of the agitator 1 is in proportion to the peripheral speed of the rotating agitator and in inverse proportion to the clearance, which is generally represented as a factor of shear rate.

The rotating speed of the agitator is critical in view of the gas entrapment due to centrifugal force the structural strength of the apparatus, so that the peripheral speed of not less than 10 m/s is generally difficult and also the higher speed rotation is not preferable from a viewpoint of safety. Therefore, in order to provide a sufficient agitating effect, it is most practical to maintain a proper clearance for molten metal (corresponds to a value obtained by subtracting thickness (d) of solidification shell from a clearance (c) of the apparatus in FIG. 3).

When the solidification shell 9 is formed at a thickness (d) by the strong cooling, the actual clearance is narrow (c–d) with respect to the clearance (c) of the apparatus. Since such a clearance is very unstable, if it is too narrow, the viscosity of the semi-solidified metal composition increases to create excessive torque in the agitator, whereby there is caused a fear of adhering the semi-solidified metal composition to the agitator. In this connection, the conventional technique could not provide the sufficient agitating effect because the clearance (c) was made large in view of the design safety. On the other hand, according to the invention, the water cooling jacket 2 can be moved toward the radial direction of the agitator 1 to optimally adjust the clearance (c), so that the sufficient agitating effect can be obtained.

In FIG. 4 is shown a second embodiment of the apparatus for the production of semi-solidified metal composition according to the invention, in which numeral 1 is a rotating agitator composed of a cylindrical drum, numeral 12 a movable wall member made from a refractory material, numeral 3 a refractory plate constituting a molten metal reservoir, numeral 4 a side refractory plate constituting the reservoir, numeral 5 a refractory plate constituting a discharge port 13 together with the lower part of the wall member 12, numeral 6 a driving mechanism for adjusting the position of the wall member 12, numeral 8 a molten metal, numeral 9 a solidification shell, numeral 10 a semi-solidified metal composition, numeral 11 a cooling water system, numeral 14 a heater for heating the wall member 12, numeral 15 a ladle, numeral 16 a pouring nozzle, numeral 17 shaping rolls, numeral 18 a scraping member, numeral 19 a driving mechanism for adjusting the position of the scraping member 18, and numeral 20 a strip of the semi-solidified metal composition 10.

In the illustrated embodiment, the wall member 12 has a concave face along the outer peripheral surface of the cylindrical drum as the agitator 1 and serves as an adiabatic wall.

In order to enlarge the clearance between the wall member and the agitator considering the fluidity of the semi-solidified metal composition as previously mentioned in FIG. 1, the temperature of the semi-solidified metal composition is measured by means of a thermometer (not shown) arranged in the discharge port 13, from which the fraction solid of the discharged semi-solidified metal composition is calculated according to an equilibrium phase diagram, and also the load torque of the agitator is simultaneously measured by means of a torque detector (not shown) and the revolution number of the shaping roll 17 or the discharging rate of the semi-solidified metal composition is measured by means of a load cell (not shown) attached to a receiver for the semi-solidified metal composition. Based on these measured values of the fraction solid, load torque and discharging rate, the wall member is moved toward the radial direction of the agitator to adjust the clearance between the wall member and the agitator at the discharging portion to provide an opening sufficient to provide given fraction solid and discharging rate, whereby the semi-solidified metal composition having a given fraction solid can continuously and stably be discharged at a given discharging rate.

In the illustrated embodiment, the agitator 1 is composed of a cylindrical drum having a horizontally rotational axis and provided with a cooling water system 11 therein, and rotated by means of a driving mechanism (not shown) connected to the rotational axis of the agitator, whereby the agitating effect is applied to molten metal under cooling to form the semi-solidified metal composition uniformly dispersing fine non-dendritic primary solid particles therein.

In the discharge port 13 for the semi-solidified metal composition 10, solidification shells or semi-solidified shells 9 adhered to the outer periphery of the rotating agitator 1 are scraped by means of the bite-like scraping member 18 made from a heat-resistant tool steel or the like to promote the separation and discharge of the semi-solidified metal composition from the agitator 1.

The molten metal 8 transferred through the ladle 15 is charged into a clearance between the agitator 1 and the wall member 12 through the pouring nozzle 16, where it is cooled by the water cooling system 11 in the agitator 1 and simultaneously subjected to strong shearing force through the agitator 1 to form a slurry of semi-solidified metal composition 10 suspending fine non-dendritic primary solid particles therein.

In the discharge of such a semi-solidified metal composition 10, the clearance between the agitator 1 and the wall member 12 is adjusted to an optimum value by moving the wall member 12 toward the radial direction of the agitator 1 as mentioned above, so that the clogging inside the apparatus can be avoided.

In order to increase the adiabatic effect, a heater 14 is preferably arranged in the wall member 12, whereby the fraction solid of the discharged semi-solidified metal composition can be adjusted to a given value.

Moreover, it is desirable that the driving mechanism 19 for moving the scraping member 18 toward the agitator 1 is connected to the scraping member 18 so that a part of the solidification shell 9 adhered to the outer periphery of the agitator 1 is left so as to protect the surface of the agitator 1 contacting with molten metal 8. In this case, the agitator 1 is rotated so as to promote the discharging flow of the semi-solidified metal composition 10, while the solidification shell adhered to the outer periphery of the agitator 1 and the semi-solidified metal composition are peeled off by the scraping member 18 to always maintain the surface state of the agitator 1 and the sectional area of the discharge portion 13 at the same levels, so that the cooling conditions and the discharging rate become uniform and hence the semi-solidified metal composition having a higher viscosity can continuously and stably be discharged.

Particularly, the scraping member 18 for peeling the solidification shell 9 of molten metal 8 adhered to the outer periphery of the agitator 1 is preferably arranged at a distance of not more than 2 mm from the outer surface of the drum to leave a part of the solidification shell on the outer surface of the agitator 1 as a self-coating, whereby the service life of the agitator 1 can be prolonged by preventing damage to the agitator due to reaction with molten metal or semi-solidified metal or the like.

FIG. 5 shows a third embodiment of the apparatus for the production of the semi-solidified metal composition according to the invention, and FIG. 6 shows a seal portion at the side of the apparatus shown in FIG. 5, and FIG. 7 enlargedly shows a discharge portion of the apparatus shown in FIG. 5.

In the illustrated embodiment, the apparatus comprises a rotating agitator 1 composed of a cylindrical drum having a horizontally rotational axis and provided with a water cooling system 11, a wall member 21 lined with a refractory wall 21*a* and having a concave face along the outer periphery of the agitator 1, a water-cooled roll 22 having a rotational axis parallel to the rotational axis of the agitator 1, a scraper 23 and a refractory side plate 4 provided at its outer face with a sealing push member 4*a*.

The rotating agitator 1 is formed by fitting a ceramic sleeve 1*b* onto a roll body 1*a* or by coating the roll body 1*a* with a ceramic material 1*b*. The agitator 1 is cooled by passing a cooling water 11 through the inside of the agitator on one hand, and heated by means of a heating member 24 such as gas burner or the like on the other hand. Furthermore, the surface temperature of the drum is measured by means of a temperature detecting device 25, whereby the heating quantity is adjusted so as to maintain a given surface temperature and control the cooling ability of the apparatus.

A clearance is defined by the rotating agitator 1, the wall member 21 and the side refractory plate 4. The wall member 21 is lined with a refractory material or ceramic 21*a* so as not to apply excessive cooling to molten metal 8 and may be preliminarily heated by means of a proper heating member (not shown).

The sealing push member 4*a* is closed to the side face of the wall member 21 together with the side refractory plate 4 through a spring or the like and slidably attached to the side face of the agitator 1 to seal molten metal 8. Moreover, it is preferable that the wall member 21 can be moved through screw, hydraulic cylinder or the like to adjust the clearance between the agitator and the wall member.

At the lower end of the discharge portion of the wall member 21 is arranged a water-cooled rotating roll 22 integrally united with the wall member at a proper space from the rotating agitator 1 in such a manner that the rotational axis is parallel to the rotational axis of the agitator 1. The roll 22 is rotated in a direction of discharging the semi-solidified metal composition or a direction shown by an arrow B (the rotating direction of the agitator 1 is shown by an arrow A) by means of the same driving mechanism as in the agitator 1 or another different driving mechanism (not shown) at a given peripheral speed lower than that of the agitator 1.

Moreover, the water-cooled rotating roll 22 is to strongly cool the semi-solidified metal composition contacting with the roll surface to solidify into a sheet strip, so that it may be made from a metal having a high heat conductivity such as Cu or the like and conduct the strong cooling by passing a cooling water through the inside of the roll.

The semi-solidified metal composition is produced by using the apparatus of FIGS. 5–7 as follows.

At first, molten metal 8 is continuously charged from the upper part of the apparatus into a clearance between the agitator 1 and the wall member 21. In this case, the molten metal 8 is subjected to a strong agitating effect by the rotating agitator 1 under proper cooling conditions to form a semi-solidified metal composition 10 containing finely dispersed non-dendritic primary solid particles therein. The semi-solidified metal composition 10 is moved in a discharging direction while increasing the fraction solid through the rotation of the agitator 1 to obtain the semi-solidified metal composition having a given fraction solid at the discharge portion of the apparatus. Such a semi-solidified metal composition 10 is strongly cooled by contacting with the water-cooled roll 22 rotating in synchronism with the agitator 1 and then continuously discharged in form of a strip.

In order to prevent the discharging of the strip 10 at a wound state on the agitator 1, the scraper 23 is arranged so as to contact with the outer peripheral surface of the agitator 1. Thus, the strip 10 wound on the agitator 1 is peeled off from the outer surface of the agitator 1 by means of the scraper 23 and continuously discharged in a given direction.

The most important action in the discharge portion in this apparatus will be described in detail with reference to FIG. 7.

The semi-solidified metal composition 10 produced in the clearance between the agitator 1 and the wall member 21 is obtained by uniformly dispersing non-endritic primary solid particles 10*a* into the remaining liquid matrix, which moves toward the discharging direction and is further cooled to form the semi-solidified metal composition having a given fraction solid in the discharge portion. This semi-solidified metal composition 10 is strongly cooled by contacting with the water-cooled roll 22 rotating in the direction of arrow B and continuously discharged as a strip.

The discharging amount of the strip of the semi-solidified metal composition 10 is represented by [drum width of the rotating agitator 1]×[space between the agitator 1 and the water-cooled rotating roll 22]×[peripheral speed of the roll 22], so that when the peripheral speed of the roll 22 is held at a constant value, the constant discharging amount is always obtained.

Moreover, a portion of the water-cooled rotating roll 22 contributing the cooling is a narrow region of angle $\alpha$ defined by a normal line at a discharge end C of the wall member 21 and a normal line at a kissing end of the roll 22. Before the semi-solidified metal composition arrives at such a region, a greater part of latent heat is previously released, so that the sufficient cooling for the solidification and the shaping into strip can be conducted in this region. The peripheral speeds of the agitator 1 and the water-cooled rotating roll 22 may the same, but in order to provide sufficient agitating force for the formation of the semi-solidified metal composition, the agitator 1 is preferably driven at a peripheral speed larger than that of the roll 22, whereby the strip of the semi-solidified metal composition having a good quality is obtained.

A fourth embodiment of the apparatus for the production of semi-solidified metal composition according to the invention is shown in FIG. 8, wherein numeral 1 is a rotating agitator composed of a cylindrical drum having a horizontally rotational axis, numeral 12 a movable wall member made from a refractory material, numeral 3 a refractory plate constituting a molten metal reservoir, numeral 4 a side refractory plate constituting the reservoir, numeral 5 a refractory plate constituting a discharge port 13 together with the lower part of the wall member 12, numeral 6 a driving mechanism for adjusting the position of the wall member 12, numeral 8 a molten metal, numeral 9 a solidification shell, numeral 10 a semi-solidified metal composition, numeral 11 a cooling water system, numeral 14 a heater for heating the wall member 12, numeral 15 a ladle, numeral 16 a pouring nozzle, numeral 17 shaping rolls, numeral 18 a scraping member, numeral 19 a driving mechanism for adjusting the position of the scraping member 18, numeral 20 a strip of the semi-solidified metal composition 10, numeral 27 a thermometer, numeral 28 a slide valve, and numeral 29 an operating mechanism for the slide valve.

The illustrated apparatus is operated in the same manner as in the apparatus of FIG. 4. In this case, the shape of the discharge portion 13 can be adjusted by the slide valve 28 arranged beneath the clearance between the agitator 1 and the wall member 12 through the operating mechanism 29. Furthermore, the temperature of the semi-solidified metal composition is measured by means of the thermometer 27, from which the discharged fraction solid is calculated according to an equilibrium phase diagram, while the load torque of the agitator 1 is measured by a torque detecting device (not shown). Based on these measured values, the slide valve 28 is adjusted so as to provide a given discharging rate by means of the operating mechanism 29. Thus, the semi-solidified metal composition having a certain fraction solid can stably and continuously be discharged and also the clogging of the apparatus can be prevented.

The shape in the nozzle of the slide valve 28 can be selected from rectangle, circle and the like, if necessary.

In FIG. 9 is shown a fifth embodiment of the apparatus for the production of the semi-solidified metal composition according to the invention, wherein numeral 1 is a rotating agitator composed of a cylindrical drum having a horizontally rotational axis and provided with a water cooling system, numeral 21 a wall member having a concave face along the outer periphery of the agitator 1, numeral 15 a ladle for molten metal 8 and numeral 23 a scraper.

In the illustrated apparatus, molten metal 8 is poured from the ladle 15 into a clearance defined between the agitator 1 and the wall member 21, where it is agitated and cooled to form a semi-solidified metal composition 10. The semi-solidified metal composition 10 is discharged in a direction tangential to the rotating direction of the agitator 1 and moved on a belt 31 driven by drive rolls 30, which are arranged beneath a discharging port of the clearance, toward the outside of the apparatus. The discharged semi-solidified metal composition 10 is passed through shaping rolls 17 to obtain a strip of the semi-solidified metal composition 10.

Thus, the semi-solidified metal composition 10 can smoothly and continuously be discharged without causing the clogging in the vicinity of the discharge port and the like. As a result, there is caused no entrapment of atmosphere in the semi-solidified metal composition and the like.

Furthermore, the transferring rate of the belt 31 can be changed by changing the rotating speed of the drive rolls 30, whereby the discharging rate of the semi-solidified metal composition can be adjusted and hence the fraction solid can easily be controlled.

In the aforementioned apparatuses, the strip of the semi-solidified metal composition having a wider width can easily be obtained by enlarging the longitudinal lengths of the agitator and wall member.

The following examples are given in illustration of the invention and are not intended as limitations thereof.

EXAMPLE 1

In this example, a strip of a semi-solidified metal composition was continuously produced by using an apparatus of FIG. 2 and a twin roll casting machine.

Molten metal 8 was charged from a ladle through a pouring nozzle into a clearance of about 10 mm defined between a rotating agitator 1 composed of a cylindrical drum having a radius of 500 mm and a length of 1000 mm and a water-cooled copper wall member 2 (which was controlled by detecting load torque of the agitator), where the agitator was rotated at 100 rpm under cooling to form a semi-solidified metal composition having a fraction solid of 0.3. Then, the semi-solidified metal composition 10 was continuously discharged from the apparatus of FIG. 2 and fed into a twin roll casting machine having a roll radius of 300 mm and a length of 700 mm to form a cast strip having a thickness of 3 mm and a width of 500 mm.

In FIG. 10 is shown an effect by controlling the clearance between the rotating agitator and the water-cooled wall member, in which dotted lines show the change of load torque of the agitator and the discharging rate of the semi-solidified metal composition when the clearance is 10 mm without control. As seen from FIG. 10, in case of no clearance control, the load torque changes in accordance with temperature change of molten metal charged, cooling change of the wall member and the like, and finally the load torque considerably increases and the discharging becomes impossible. On the other hand, as shown by a solid line in FIG. 10, when the clearance is controlled by detecting the load torque of the agitator according to the invention, the load torque is maintained at an approximately constant value and hence the semi-solidified metal composition having a fraction solid of 0.3 is stably discharged.

EXAMPLE 2

A semi-solidified metal composition was produced from molten metal of Al-4.5% Cu alloy by using the apparatus shown in FIG. 4.

The molten metal was poured into a clearance of 5 mm defined between the refractory wall member 12 and the agitator 1 in the discharge portion 13, where the agitator 1 having an outer diameter of 400 mm was rotated at 250 rpm while cooling under a condition that average solidification rate was 3.0%/s, whereby a semi-solidified metal composition was formed. The temperature of the resulting semi-solidified metal composition discharged from the discharge portion 13 was measured by means of a thermometer (not shown), from which the fraction solid was calculated to be 25% according to an equilibrium phase diagram. Thus, the semi-solidified metal composition could continuously and stably be produced and discharged without causing the clogging of the clearance.

In FIG. 11 is shown a comparison between Example 2 (solid line) and Comparative Example (dotted lines, no clearance control) in changes of fraction solid and discharging rate with the lapse of time. As seen from FIG. 11, the fraction solid and the discharging rate become stable in the invention, while in the comparative example, the changes of the fraction solid and discharging rate are allowed to cause the clogging of the apparatus and stop the discharging of the semi-solidified metal composition.

EXAMPLE 3

A semi-solidified metal composition was produced from molten metal of Al-10% Cu alloy in the same manner as in Example 2.

The molten metal was poured into a clearance of 5 mm defined between the refractory wall member 12 and the agitator 1 in the discharge portion 13, where the agitator 1 was rotated at 120 rpm while cooling under a condition that average solidification rate was 0.45%/s, whereby a semi-solidified metal composition was formed. Furthermore, the scraping member 18 was arranged at a distance of 1 mm from the agitator 1 so as to form a self-coating of solidification shell of 1 mm in thickness on the outer surface of the agitator 1. As a result, the semi-solidified metal composition having a fraction solid of 32% as calculated from a temperature measured at the discharge portion 13 could continuously and stably be produced and discharged.

EXAMPLE 4

A semi-solidified metal composition was continuously produced from molten metal of Al-10% Cu alloy by using the apparatus shown in FIG. 5.

At first, molten metal was poured at about 700° C. into a clearance of 5 mm defined between the water-cooled rotating agitator 1 composed of a cylindrical drum having a diameter of 400 mm and a drum width of 100 mm and the wall member 21, in which the wall member was preliminarily heated to 550° C. by means of a gas burner and the outer surface of the drum was heated to 530° C. and the agitator was rotated at 100 rpm (peripheral speed: 2093 mm/s) under a controlled cooling state of 600 kcal/min without the water-cooled rotating roll. As a result, the semi-solidified metal composition having a fraction solid of 0.2 and a good quality could be produced, but it was actually difficult to continuously discharge this semi-solidified metal composition because the composition was substantially at a state just before the loss of fluidity.

According to the invention, a water-cooled rotating roll 22 having a diameter of 150 mm was arranged in the lower end portion of the wall member 21 at a space of 2 mm from the agitator 1 and rotated at 100 rpm (peripheral speed: 785 mm/s) in synchronism with the agitator 1 under a cooling condition of 400 kcal/min. As a result, a strip of semi-solidified metal composition having a thickness of 2 mm and a width of 100 mm was continuously discharged from the apparatus of FIG. 5 at a discharging rate of about 785 mm/s.

The thus obtained strip was at a substantially solidified state and had substantial strength, so that it could continuously be wound into a coil.

EXAMPLE 5

A semi-solidified metal composition was continuously produced from molten metal of Al-4.5% Cu alloy by using the apparatus shown in FIG. 8.

At first, molten metal was poured into a clearance of 5 mm defined between the water-cooled rotating agitator 1 composed of a cylindrical drum having an outer diameter of 400 mm and the wall member 21, in which the agitator 1 was rotated at 250 rpm while cooling under a condition that average solidification rate was 3.1%/s. On the other hand, the slide valve 19 having a diameter of 20 mm was arranged beneath the discharge portion 13 so as to have a nozzle opening degree of 10 mm, while the temperature of the resulting semi-solidified metal composition was continuously measured by means of the thermometer 27, from which a fraction solid was calculated to be 0.27 according to an equilibrium phase diagram. Thus, the semi-solidified metal composition could continuously and stably be produced and discharged without causing the clogging of the apparatus.

EXAMPLE 6

A semi-solidified metal composition was continuously produced from molten metal of Al-10% Cu alloy in the same manner as in Example 5.

In this case, molten metal was poured into a clearance of 5 mm defined between the water-cooled rotating agitator 1 and the wall member 21, in which the agitator 1 was rotated at 120 rpm while cooling under a condition that average solidification rate was 0.46%/s. The resulting semi-solidified metal composition was discharged through the slide valve 28 having a diameter of 20 mm and a nozzle opening degree of 10 mm, which was arranged beneath the discharge portion 13, while forming a self-coating of solidification shell of 1 mm onto the outer surface of the agitator 1 by arranging the scraping member 18 in the agitator 1 at a distance of 1 mm therefrom.

Thus, the semi-solidified metal composition having a fraction solid of 0.31 as calculated from a temperature measured at the discharge portion could stably be produced and discharged.

EXAMPLE 7

A semi-solidified metal composition was produced from molten metal of Al-10% Cu alloy by using the apparatus shown in FIG. 9.

In this case, the rotating agitator 1 composed of a cylindrical drum having a horizontally rotational axis and a diameter of 400 mm and a width of 100 mm was arranged to the wall member 21 having a concave face along the outer periphery of the agitator 1 so as to form an outlet size of 5 mm in a clearance defined between the agitator and the wall member. The molten metal was continuously poured into the clearance at about 700° C., at where the agitator 1 was rotated 100 rpm to form a semi-solidified metal composition having a fraction solid of 0.3.

In the conventional technique of discharging downward by gravity, the semi-solidified metal composition having the high fraction solid could not be discharged because the viscosity was too high. However, in the apparatus of FIG. 9, the semi-solidified metal composition could be continuously discharged by horizontally guiding the flow of the semi-solidified metal composition in a direction tangential to the outer periphery of the agitator 1 and simultaneously taking it out through the belt drive system 30, 31.

As mentioned above, the invention has the following merits in the production of the semi-solidified metal composition:

(1) It makes possible to conduct the strong cooling operation as well as the operation at optimum minimum clearance from a viewpoint of agitation effect and safeness, so that the cooling rate can be rendered into not less than 3° C./s (in case of Al-10% Cu alloy) and also the semi-solidified metal composition containing fine non-dendritic primary solid particles therein and having improved properties can be produced. Particularly, the productivity becomes high and practical because of the strong cooling.

(2) Since the agitation is carried out at an optimum minimum clearance, the sufficient agitating effect is obtained even when the rotating speed is made slow as compared with the conventional technique, and also a risk of entrapping gas during the high speed rotation and all problems with respect to the structure, strength and safeness of the apparatus can be solved.

(3) The quality of the semi-solidified metal composition is stabilized because the operation can be carried out at optimum minimum clearance and cooling rate.

(4) The operation can easily cope with the excessive formation of solidification shell at non-steady state in initial operation stage. Furthermore, since load torque is constantly controlled in the continuous operation over a long time, there is no trouble such as adhesion or clogging of semi-solidified metal composition in the apparatus.

(5) When the semi-solidified metal composition is charged into a twin roll casting machine, it can uniformly be supplied in the widthwise direction of the machine, so that it is possible to produce thin and homogeneous metal sheets having excellent properties.

(6) When the water-cooled rotating roll is arranged in the lower discharge end of the apparatus for the formation of semi-solidified metal composition, the strip of the semi-solidified metal composition can continuously and stably be produced, so that it largely contributes to the practicability of semi-solidified working process.

(7) A self-coating of solidification shell can be formed on the surface of the rotating agitator used under severe conditions, so that the service life of the agitator can be prolonged and also the material of the agitator to be used can be widened.

(8) The semi-solidified metal composition can continuously and stably be produced and discharged even in the production apparatus being poor in the fluidity and high in the solidification rate, so that the stable operation can be attained without causing the clogging inside the apparatus.

What is claimed is:

1. A process for continuously producing semi-solidified metal compositions in which non-dendritic primary solid particles are dispersed into remaining liquid matrix by conducting vigorous agitation in a molten metal cooling and solidification step, which comprises continuously charging molten metal into a clearance defined between a rotating agitator composed of a cylindrical drum having a horizontally rotational axis and a wall member having a concave face along an outer periphery of the drum, where dendrites produced by solidification based on forced cooling are broken through shearing force based on rotation of said rotating agitator to form a semi-solidified metal composition suspending fine non-dendritic primary solid particles, and then continuously discharging out the resulting semi-solidified metal composition from a lower part of said clearance.

2. The process according to claim 1, wherein the forced cooling is carried out by passing a cooling water through the inside of the agitator and/or the wall member.

3. The process according to claim 1, wherein the clearance is properly adjusted by detecting load torque of the agitator to move the agitator or the wall member.

4. The process according to claim 1, wherein the solidification shell adhered to the outer peripheral surface of the drum is scraped off by means of a scraping member arranged near to the drum at a discharge port for continuously discharging the semi-solidified metal composition from the lower part of the clearance.

5. The process according to claim 4, wherein a water-cooled rotating roll is arranged at the lower end of the wall member located opposite to the scraping member below the clearance so that the rotational axis is parallel to the rotational axis of the agitator.

6. The process according to claim 5, wherein the peripheral speed of the agitator is higher than that of the water-cooled rotating roll.

7. The process according to claim 4, wherein a slide valve is arranged beneath the clearance to hold the semi-solidified metal composition and adjust the discharging rate of the semi-solidified metal composition and the shape of the discharge port by the slide valve.

8. The process according to claim 1, wherein the the semi-solidified metal composition is horizontally discharged in a tangential direction of the outer periphery of the drum and placed onto a belt or caterpillar for continuously introducing into subsequent steps, and the discharge of the semi-solidified metal composition is adjusted by controlling the take-up velocity of the belt or caterpillar.

9. An apparatus for producing semi-solidified metal composition, comprising a rotating agitator composed of a cylindrical drum and a wall member having a concave face along an outer periphery of the drum, characterized in that the agitator has a horizontally rotational axis.

10. The apparatus according to claim 9, wherein a torque detector is arranged on the rotational axis of the agitator.

11. The apparatus according to claim 9, wherein a cooling means is arranged inside the wall member and/or the agitator.

12. The apparatus according to claim 9, wherein a scraping means for scraping solidification shell adhered to the outer peripheral face of the drum is arranged near to the outer periphery of the drum beneath the clearance.

13. The apparatus according to claim 12, wherein a water-cooled rotating roll is arranged at the lower end of the wall member located opposite to the scraping member below the clearance so that the rotational axis is parallel to the rotational axis of the agitator.

14. The apparatus according to claim 9, wherein a slide valve is arranged beneath the slide valve.

* * * * *